United States Patent [19]

Peterson

[11] 4,152,973

[45] May 8, 1979

[54] HEAT ENERGY HOMOGENIZER

[76] Inventor: Fred M. Peterson, 3232 Shawnee Trail, Fort Worth, Tex. 76135

[21] Appl. No.: 833,969

[22] Filed: Sep. 16, 1977

[51] Int. Cl.[2] ..... F24F 13/02

[52] U.S. Cl. ..... 98/33 A; 98/29; 98/38 E

[58] Field of Search ..... 98/33 R, 33 A, 29, 38 R, 98/DIG. 7, 38 B–38 F; 138/106

[56] References Cited

U.S. PATENT DOCUMENTS

| | | | |
|---|---|---|---|
| 1,170,551 | 2/1916 | Marty | 98/33 A |
| 1,571,228 | 2/1926 | Barducci | 98/33 A |
| 2,091,562 | 8/1937 | Palmer | 98/33 A |
| 2,167,472 | 7/1939 | Bedford | 98/33 A |
| 2,615,383 | 10/1952 | Jenn | 98/33 A |
| 2,765,726 | 10/1956 | Powers | 98/38 E |
| 3,173,353 | 3/1965 | Watkins | 98/29 |
| 3,827,342 | 8/1974 | Hughes | 98/33 A |
| 3,973,479 | 8/1976 | Whiteley | 98/33 A |
| 4,053,732 | 10/1977 | Canter | 98/33 A |

FOREIGN PATENT DOCUMENTS

| | | | |
|---|---|---|---|
| 725961 | 8/1942 | Fed. Rep. of Germany | 98/33 A |
| 1246977 | 8/1967 | Fed. Rep. of Germany | 98/33 A |
| 2296818 | 7/1976 | France | 98/33 A |

*Primary Examiner*—Henry C. Yuen

*Attorney, Agent, or Firm*—Dennison, Dennison, Meserole & Pollack

[57] ABSTRACT

An air homogenizer for the elevation and equalization of temperature within the occupant zone of a room comprising a vertical air passage with a first air inlet positioned adjacent the room ceiling for the intaking of the warmer air thereat and a second air inlet positioned adjacent the room floor for the intaking of the cooler air thereat. An air outlet is positioned within the occupant zone, generally at approximately mid height therein, and a powered flow of air is effected through the inlets for comingling or homogenizing and discharge through the outlet, providing a zone of relatively stable warmer air wherein there is little tendency for the air to stratify.

14 Claims, 8 Drawing Figures

70
66
62
68
64
68
78
74
76
76
82
80
5
5
78
72

84
86
90
88
72

76
68
66
66
80
78
68
76

HEAT ENERGY HOMOGENIZER

BACKGROUND OF THE INVENTION

The present invention relates to a unique system for heating and equalizing the temperature within the occupant zone of a room or enclosure. More particularly, the invention herein involves a system whereby the warmer and cooler air, respectively adjacent the ceiling and floor of a room, are drawn vertically toward each other for comingling or homogenizing and discharge into the occupant zone, achieving a zone of relatively stable air which has substantially no tendency to rise or fall or stratify.

The state of the prior art known to Applicant is exemplified by the following patents:

U.S. Pat. No. 1,698,763–McCauley
U.S. Pat. No. 3,173,353–Watkins
U.S. Pat. No. 3,347,025–Wiley
U.S. Pat. No. 3,612,039–Falk
U.S. Pat. No. 3,827,342–Hughes
U.S. Pat. No. 3,973,479–Whiteley These patents are concerned with the known broad concept of moving the warmer "ceiling" air to the floor or the cooler "floor" air to the ceiling in an effort to equalize temperature and reduce stratification. Note for example the patent to Whiteley, U.S. Pat. No. 3,973,479, wherein two oppositely directed floor to ceiling flows are produced. Watkins, U.S. Pat. No. 3,173,353, and Hughes, U.S. Pat. No. 3,827,342 are each concerned with the forced movement of air in a single direction between floor and ceiling.

SUMMARY OF THE INVENTION

The present invention is concerned with a temperature equalization system for a room wherein both "ceiling" and "floor" air are vertically drawn through closed air passage means to an intermediate level of the room, falling within the occupant zone, whereat the air is comingled, mixed or homogenized and subsequently discharged directly into the occupant zone. The discharged homogenized air produces a zone of highly stable air with no tendency to stratify and very little tendency to produce a natural vertical flow such as would inherently occur were warmer air from the ceiling discharged directly at the floor level. In other words, the homogenized air, discharged within the occupant zone, does not tend to either rise or fall at discharge, but on the contrary, tends to remain stable within the occupant zone.

The system normally includes vertical air passage or duct means having upper and lower intakes with an intermediate outlet through which air drawn from the intakes is discharge, subsequent of course to a mixing or homogenizing thereof. The structure itself can be free standing, wall mounted, incorporated directly within wall construction, such as between adjacent studs, or actually formed as an integral portion of a central air-conditioning system.

DESCRIPTION OF THE PREFERRED EMBODIMENTS

It should be understood initially that the device is intended basically to forceably draw air from both the ceiling and floor areas of a room for a comingling or mixing thereof and a subsequent discharge into the liveable area of the room hereinafter referred to as the occupant zone.

The term homogenize is used to designate the mixing and comingling of the warmer and colder air respectively received from the ceiling and floor areas.

The occupant zone designates that area of a room or enclosure, regardless of the height thereof, which a person or persons will normally occupy. This area or zone will normally extend from the floor to approximately 6 ½ feet. Further, as the occupants of a room for any length of time will normally either be seated or lying down, as in a bedroom, the discharge of the homogenized air should preferably occur at approximately arm chair height for maximum comfort.

Figure 1:
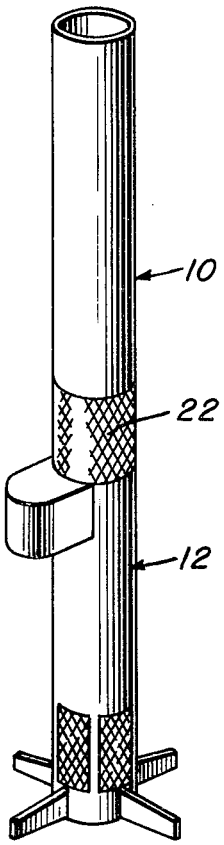
FIG. 1 is a perspective view of a free standing air homogenizer in accordance with the present invention.
Figure 2:
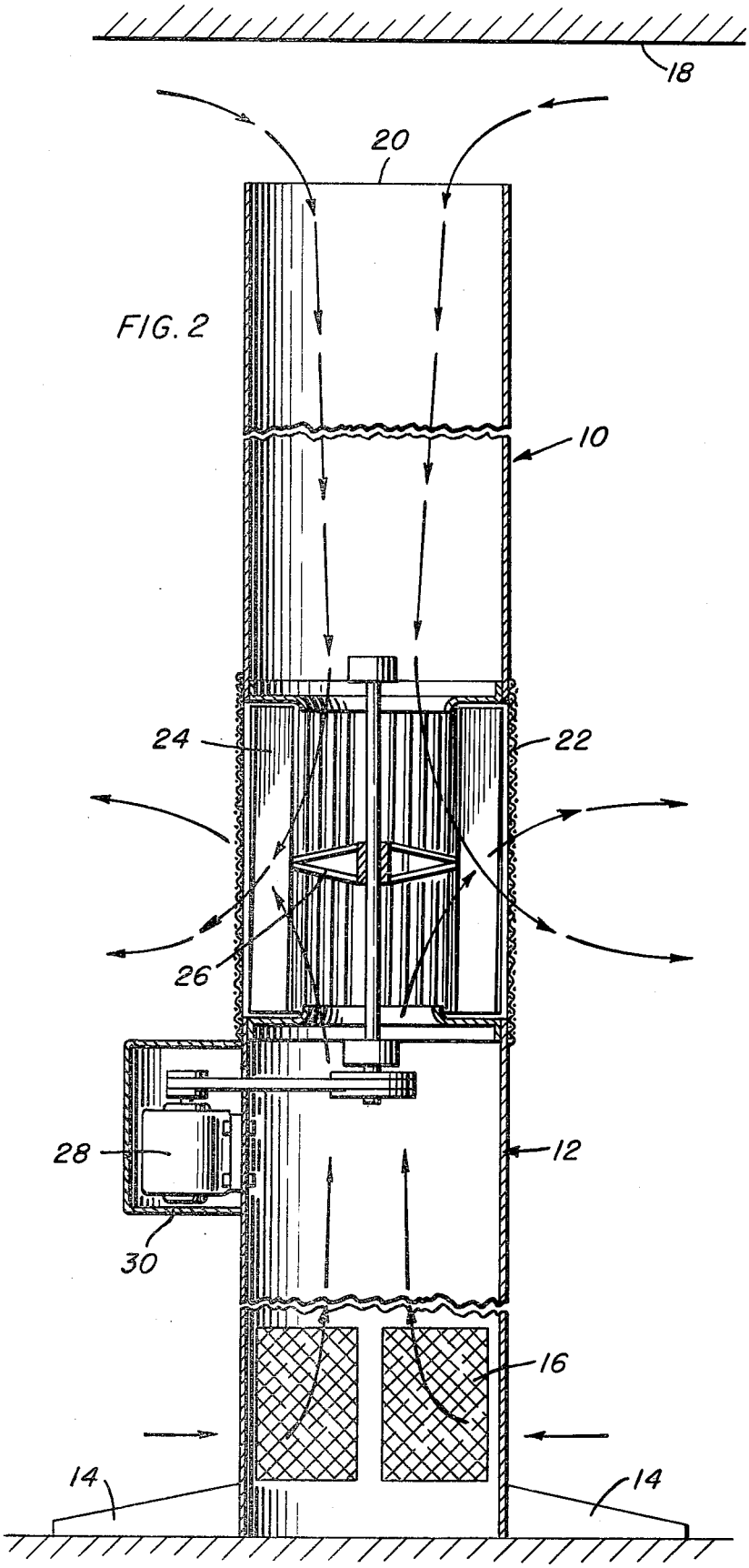
FIG. 2 is an enlarged vertical cross-sectional view through the homogenizer of FIG. 1.

Referring now more specifically to the drawings, the basic air homogenizer 10 is illustrated as a free standing embodiment in FIGS. 1 and 2. It will be noted that this homogenizer 10 consists essentially of a vertically elongated tube or duct 12 having a floor supported lower end stabilized by radially projecting feet 14 so as to provide for a self-supporting unit.

The air intake or inlet for the cooler "floor" air consist of several screen protected openings 16 through the lower portion of the duct 12. If so desired, appropriate fixed direction or adjustable louvers can also be provided in conjunction with the openings 16. The size of the opening or openings 16 is to be such so as to enable an adequate intake of air without inducing disruptive air flows, excessive noise, or the like.

The open upper end 20 of the duct 16, which also might be designated a housing, terminates adjacent the ceiling 18 of the room with this upper end constituting the intake or inlet for the warmer "ceiling" air. As such, it will of course be appreciated that the open upper end or inlet will of necessity be spaced sufficiently distance from the actual ceiling so as to enable an adequate forced introduction or drawing of air therein. This open end of the duct 12 can also be louvered or screened as desired.

An air outlet opening 22 is provided at a point intermediate along the length of the duct or housing 12. This outlet 22 can extend either partially or completely about the duct 12 with the upper and lower duct sections suitably structurally inter-connected. As with the inlet openings, the outlet opening 22 can be provided with a suitable screen or louvered grill, either fixed or adjustable. Further, the outlet is to be so positioned as to effect a discharge of air into the occupant zone.

In the homogenizer 10 as illustrated in FIG. 1, the outlet 22 is at or slightly below approximately mid height. Such an arrangement would be particularly adapted for a room, such as a store or the like, wherein the occupants would normally be standing. Should it be desired to use the homogenizer 10 in a home, the outlet 22 will normally be located so as to effect a lower discharge of the homogenized air.

The actual air flow, as indicated by the arrows in FIG. 2, is a forced air flow effected by a motor driven fan unit 24 located internally within the duct 12 and axially aligned with the duct, in radial alignment with the outlet 22, so as to induce an axial flow of the "floor" and "ceiling" air inwardly through the floor and ceiling inlets 16 and 20 for a comingling, mixing or homogenizing of the two air streams at the outlet 22 immediately prior to, during and immediately subsequent to the lateral outward movement of the air through the outlet 22. The fan can be in the nature of a vertically elongated squirrel cage type blower with a solid central web 26, and can be mounted in any appropriate manner through suitable cross bracing. The drive motor 28, preferably an electric motor, either can effect a direct drive of the fan shaft or a pulley driving thereof as suggested in FIG. 2. In this instance, the motor 28 is bolted to the exterior of the duct 12 within a small removable housing 30.

Figure 3:
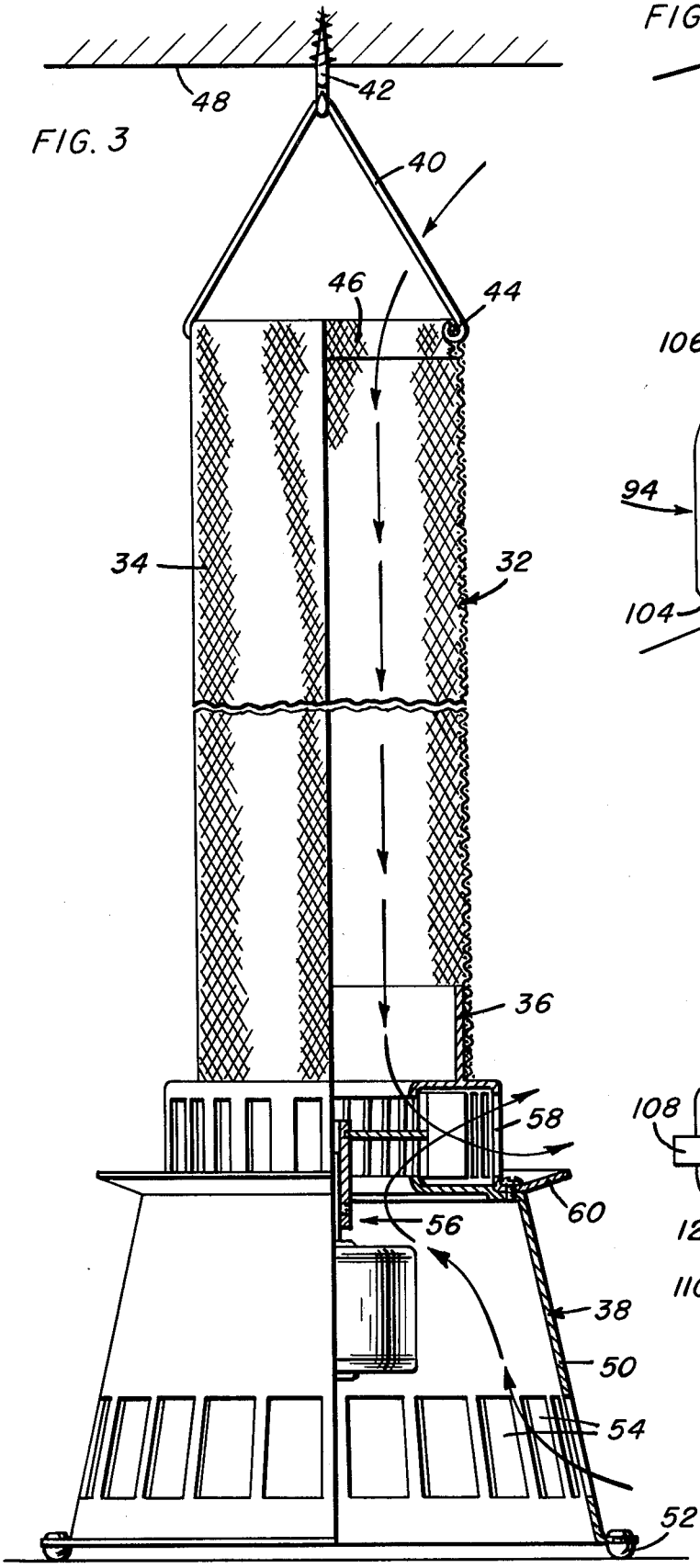
FIG. 3 is a vertical view, partially in cross-section, of a modified form of portable air homogenizer.

FIG. 3 illustrates a further embodiment of the homogenizer, designated by reference numeral 32, wherein a major portion of the height of the air passage forming duct is in the nature of a collapsible flexible sleeve 34 of appropriate air impervious material. The lower end of the sleeve will closely engage about an upstanding annular flange 36 affixed to the base unit 38. The upper end of the sleeve 34, when extended, will be suspended by a wire bail 40 selectively engaged with a ceiling mounted hook 42 so as to maintain the sleeve 34 upright. The bail 40 will appropriately engage with a wire ring 44 to which the fabric of the sleeve 34 is secured and which defines the desired open upper inlet end 46 positionable adjacent the ceiling 48 in operative position.

The base 38 includes a hollow truncated conical housing 50 supported on rubber gripping feet 52 and provided with a series of peripheral openings 54 which define the lower or "floor" air inlet. A motor driven fan unit 56 mounts on the upper portion of the base, through any appropriate mounting bars, straps, or the like, and effects a vertical axial inward drawing of both "ceiling" air and "floor" air for a lateral discharge thereof through an appropriate discharge grill 58, louvered if so desired. Arrows have also been used to generally designate the air flow.

Inasmuch as the base 38 in this embodiment may be relatively low so as to provide for a compact easily moved unit upon a collapsing of the sleeve 34, a directing of the discharging homogenized air to the desired height within the occupant zone can be facilitated by the provision of an upwardly inclined flange deflector 60 peripherally about the base housing 50 immediately outward of the discharge grill 58.

Figure 4:
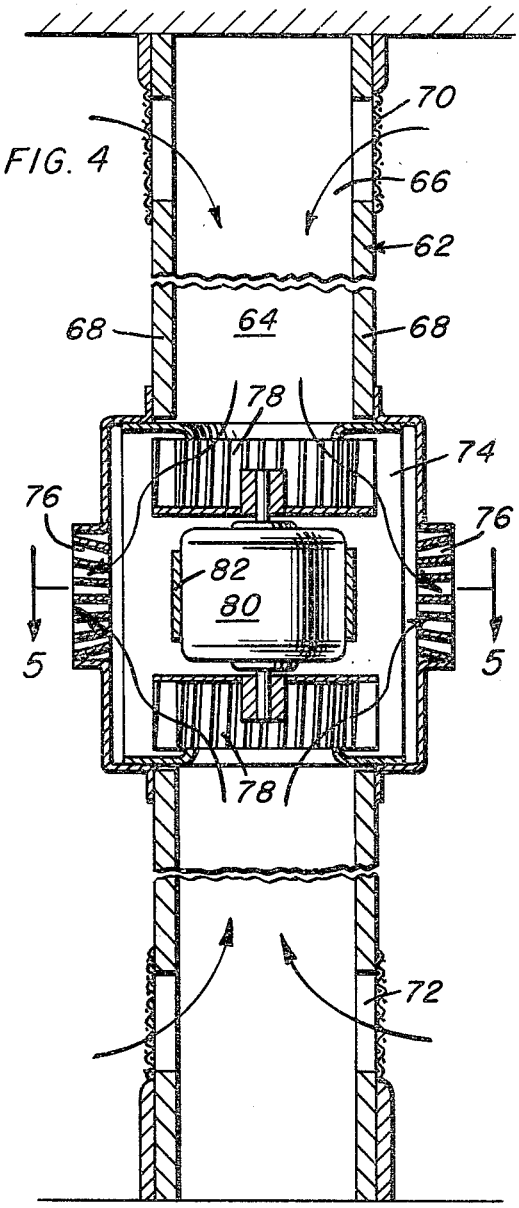
FIG. 4 is a vertical cross-sectional view through a partition wall incorporating the air homogenizer system of the invention therein.

In the embodiment of FIG. 4, the air homogenizer is incorporated within a partition wall 62 with the vertical air passage or duct 64 defined between a pair of adjacent studs 66 and enclosed by opposed facing panels 68.

First air inlets 70 are provided through the opposed facing panels adjacent the ceiling while second air inlets 72 are provided through the facing panels 68 adjacent the floor. A fan housing or enclosure 74 is mounted at an intermediate position along the vertical air passage 64 so as to correspond with the desired height within the occupant zone for the discharging air which, upon being mixed or homogenized, discharges through the laterally directed louvered or grilled outlets 76.

The movement of the air through the upper and lower inlets for discharge through the intermediate outlets will be effected by upper and lower bladed fans or blower wheels 78 engaged with oppositely projecting drive shafts of a centrally mounted motor 80. The motor 80 is secured in any appropriate manner between the studs 66 for example by mounting straps 82. It is to be appreciated that the mounting of the components, and in particular the grills or louvers, will be arranged so as to allow access to the interior of the fan compartment or housing should such be required. Further, the exact nature of the air directing discharge louvers can be varied in accordance with the demands of a particular situation. For example, the louvers can be adjustable or oriented so as to provide for increased turbulence to further encourage the homogenizing or comingling of the two air streams. In addition, while the air homogenizer of FIG. 4 illustrates both an intake and discharge to two sides of the partition, thus accommodating two adjacent rooms, the intake and discharge can be to a single side for single room use.

Figure 6:
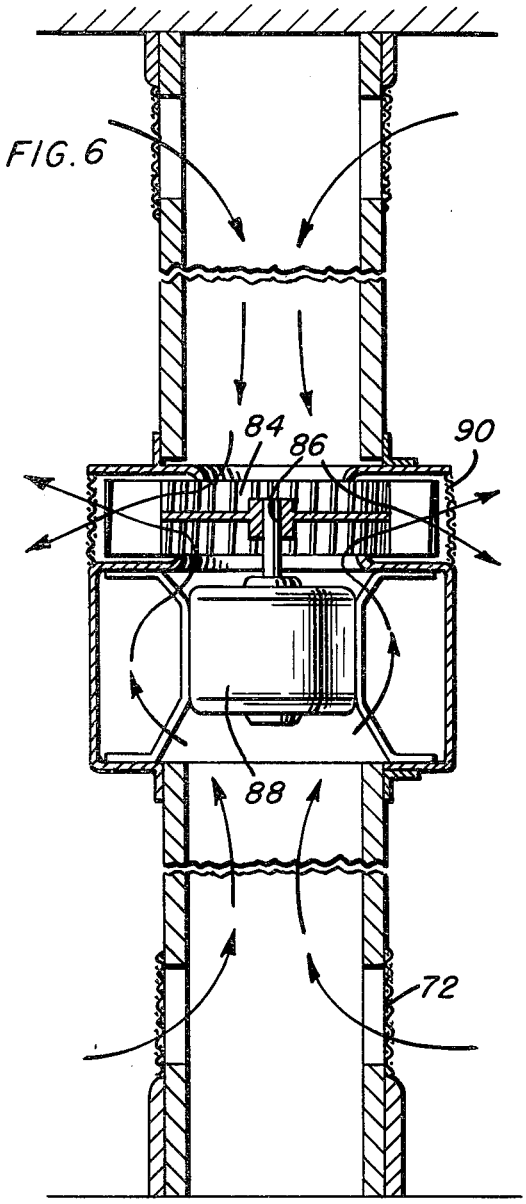
FIG. 6 is a vertical cross-sectional view through a partition wall, similar to FIG. 4, wherein a modified fan unit is provided.
Figure 5:
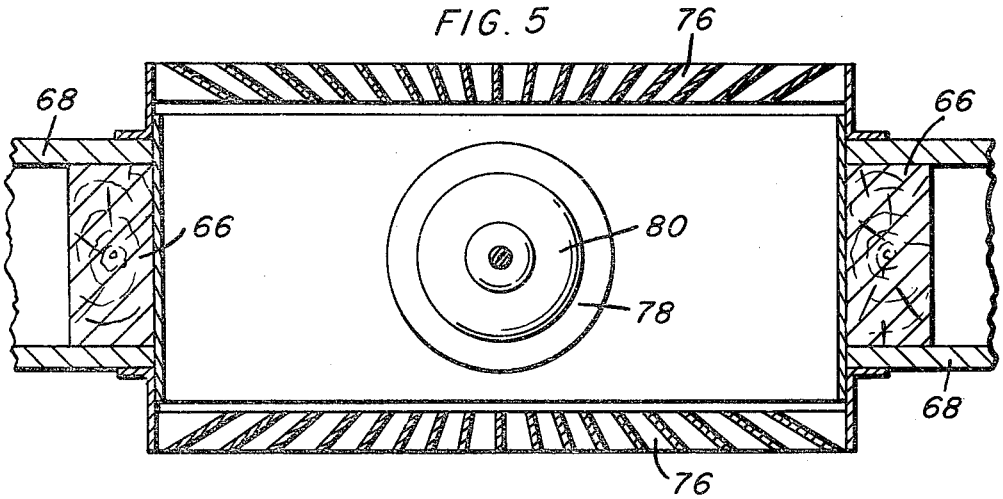
FIG. 5 is a cross-sectional detail taken substantially on a plane passing along line 5—5 in FIG. 4.

FIG. 6 is a variation of the partition air homogenizer of FIG. 4, illustrating the use of a single fan or blower wheel 84 mounted on the single drive shaft 86 of a centrally located electric motor 88 also provided so as to effect a discharge of the air, through a screened or louvered outlet 90, into the occupant zone between the upper and lower inlets. As will be appreciated, the fan or blower 84 is of a size so as to effectively axially draw the inlet air thereto and radially discharge this air. Further, the housing, as in the case with the arrangement in FIG. 4, should be such so as to allow access to the interior thereof for servicing, installation, and the like.

Figure 7:
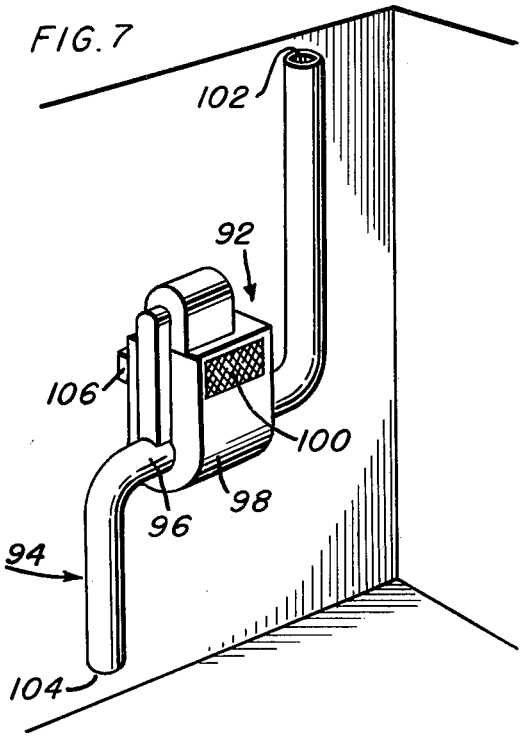
FIG. 7 is a perspective view of a wall mounted embodiment of the air homogenizer of the present invention.

FIG. 7 illustrates a wall mounted form of air homogenizer 92 wherein the vertical air passage forming duct 94 includes a relatively long horizontal intermediate portion 96 which mounts the housing 98 enclosing the motor driven blower and homogenized air outlet or discharge 100. Utilizing the horizontal intermediate section 96 within the vertical air duct 94 allows a substantial lateral positioning of the "ceiling" air inlet 102 and the "floor" air inlet 104 respectively positioned closely adjacent the ceiling and floor of the room. This lateral positioning of the inlets allows for a better accommodation of large areas for an equalization of the temperature within the occupant zone, and as such, this embodiment would most likely find its more practical usage within large commercial or industrial buildings. The actual mounting of the assembly on the wall can be effected in any appropriate manner, such as through mounting brackets 106 or the like.

Figure 8:
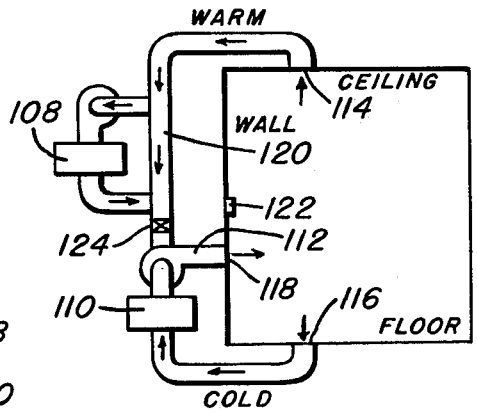
FIG. 8 is a schematic view of one manner of incorporating the air homogenizer system of the present invention into an air-conditioning system incorporating both an air heater and an air cooler.

FIG. 8 schematically illustrates the homogenizer in combination with a room or home air-conditioning system including a heater or furnace 108 and a cooling unit 110.

As in the previously described systems, appropriate blower means 112 acts so as to inwardly draw the air from the ceiling inlet 114 and floor inlet 116 for discharge into the occupant zone through outlet 118. In the system of FIG. 8, that portion of the air passage or duct 120 above the blower 112 can be, through appropriate bypass ducting, directed through the heating unit or furnace 108 which will be activated during those periods when additional heat is needed so as to bring the temperature of the homogenized air to a comfortable level as sensed by any appropriate thermostat means 122 or the like.

The cooling unit 110 is located within that portion of the air passage or duct between the floor inlet 116 and the blower unit 112 for selective use when additional cooling is required. In those circumstances wherein additional cooling is required within the occupant zone, and inasmuch as the occupant zone extends upwardly from the floor, a damper 124 can be provided in the air passage immediately above the blower unit 112 for a closing thereof. At such times, it will of course be appreciated that the heating unit or furnace is off. By the same token, the cooling unit will not be operative during those periods wherein it is necessary to raise the temperature within the occupant zone so as to achieve a comfortable level.

From the foregoing, it will be appreciated that a distinctive system has been devised for heat energy conservation. Basically, provision is made for comingling, mixing or homogenizing the warm air from adjacent the ceiling with the cool or cold air adjacent the floor and discharging the homogenized air directly within the occupant zone of the room. In this manner, a high degree of stability and lack of air stratification is achieved. Also, the rapid vertical movement of air, as occurs in those systems wherein the cold air from the floor is moved directly to the ceiling and or the warm air from the ceiling is moved directly to the floor, is eliminated. The actual system can be incorporated within a free standing assembly, internally within a partition wall, externally on a wall, or as a part of a central air-conditioning system.

As will be appreciated, the foregoing is considered illustrative of the principals of the invention and since modifications and changes may occur to those skilled in the art, it is not desired to limit the invention to the exact construction and operation shown and described. Accordingly, all suitable modifications and equivalents may be resorted to, following within the scope of the invention as claimed.

I claim:

1. For use in a room including a floor and ceiling, and an intermediate occupant zone vertically between the floor and ceiling; air homogenizer means for equalizing the temperature within said occupant zone, said homogenizer means comprising a single vertical air passage duct having opposite ends constituting upper and lower ends positioned respectively adjacent the ceiling and floor of the room, a first air inlet means located at the upper end of the air passage duct adjacent the room ceiling, second air inlet means located at the lower end of the air passage duct adjacent the room floor, and air outlet means positioned at an intermediate point along said single vertical air passage duct between the upper and lower ends and between the first and second air inlet means and at a height along said air passage duct so as to discharge into the occupant zone of the room, and power means for drawing air through said first and second air inlet means and vertically through said air passage duct toward said air outlet means, comingling the air from the first and second air inlet means at said air outlet means, and discharging the comingled air through the air outlet means into the occupant zone to define an area of stable air.

2. The air homogenizer means of claim 1 wherein said power means comprises a fan mounted within said air passage duct in alignment with said outlet means for a lateral forced discharge of the air therethrough.

3. The air homogenizer means of claim 1 wherein said vertical air passage duct comprises a floor engaging base, the upper end of said duct being open and constituting said first air inlet means.

4. The air homogenizer means of claim 3, wherein said second air inlet means is defined laterally through said duct.

5. The air homogenizer means of claim 4 wherein said duct, above said base, is selectively vertically collapsible and extensible.

6. The air homogenizer means of claim 5 wherein said duct, above said base, comprises a flexible sleeve, and means for selectively suspending the upper end of the sleeve from the ceiling.

7. The air homogenizer means of claim 6 including an air deflector immediately outward of the air outlet means and oriented so as to direct the air to a predetermined level within the occupant zone.

8. The air homogenizer means of claim 1 in combination with a multiple stud partition forming a wall of the room, said vertical air passage duct being defined by said partition between a pair of adjacent studs.

9. The air homogenizer means of claim 8 wherein said partition includes opposed facing panels affixed to and across said studs, each of said first and second air inlet means opening laterally through the opposed facing panels, said air outlet means also opening through said opposed facing panels.

10. The air homogenizer means of claim 1 wherein said air passage duct terminates in open upper and lower ends which respectively constitute the first and second air inlet means.

11. The air homogenizer means of claim 10 wherein an intermediate portion of the duct extends generally horizontally, offsetting the upper and lower portions of the duct relative to each other, said air outlet means being positioned within the generally horizontally extending intermediate portion.

12. The air homogenizer means of claim 11 including for mounting the vertical duct means on a wall of the room with the open upper and lower ends thereof respectively vertically spaced from the ceiling and floor.

13. The air homogenizer means of claim 1 in combination with selectively usable air heating means communicating with the air passage duct between the first air inlet means and the air outlet means, and selectively usable air cooling means communicating with the air passage duct between the second air inlet means and the air outlet means.

14. The air homogenizer means of claim 13 including damper means for selectively closing said air passage duct directly above said air outlet means.

* * * * *